United States Patent [19]

Zimmerman

[11] 3,952,941

[45] Apr. 27, 1976

[54] BOTTOM LOCKING CARTON

[75] Inventor: John Zimmerman, Willowdale, Canada

[73] Assignee: Somerville Industries Limited, London, Canada

[22] Filed: Oct. 3, 1975

[21] Appl. No.: 619,260

[30] Foreign Application Priority Data

Dec. 9, 1974 Canada ..... 215702

[52] U.S. Cl. ..... 229/41 B; 229/27

[51] Int. Cl.[2] ..... B65D 5/48

[58] Field of Search ..... 229/41 R, 41 B, 27, 229/28; 206/171

[56] References Cited

UNITED STATES PATENTS

| | | | |
|---|---|---|---|
| 2,702,154 | 2/1955 | Linson | 229/41 B X |
| 2,785,844 | 3/1957 | Metzger | 229/41 B X |
| 3,118,589 | 1/1964 | Hughes | 229/27 |
| 3,184,143 | 5/1965 | Kotowick | 229/28 |
| 3,836,065 | 9/1974 | Hackenberg | 229/41 B X |

*Primary Examiner*—Davis T. Moorhead

*Attorney, Agent, or Firm*—Fetherstonhaugh & Co.

[57] ABSTRACT

An improvement in a bottom locking structure of a lay-flat type carbon of the type commonly used as a carton for beer bottles, the carton having divider panels formed from extensions of the bottom wall panels thereof. The improvement consisting of slot means opening through one of the divider panels at its hinged connection with respect to a side bottom wall panel and lug means projecting outwardly from the other side bottom panel, the lug means mating with the slot means as the carton moves to the erect configuration to provide a bottom wall interlock substantially in the plane of the bottom wall which serves to resist the return to the lay-flat configuration. In addition, the carton provides the further improvement wherein a side wall handle reinforcing panel is initially formed integrally with an end bottom wall panel. The end bottom wall panel is folded along its hinged connection with an end wall to locate the reinforcing panel to an intimate underlying relationship with respect to the end wall panel. The reinforcing panel is adhesively secured to the end wall panel which it underlies. The reinforcing panel is released from the bottom end wall panel during movement of the carton from the lay-flat configuration to the erect configuration.

10 Claims, 6 Drawing Figures

BOTTOM LOCKING CARTON

This invention relates to lay-flat cartons of the type which include divider panels formed integrally with the bottom wall forming panels and articulately connected to one another to be automatically located in the required longitudinal and laterally extending relationship upon erection of the carton. In particular, this invention relates to an improved interlocking structure for connecting the bottom wall forming panels and divider panels in the erect configuration.

Difficulty has been experienced in attempting to provide an effective box interlock for retaining the divider panels of a carton in an erect configuration prior to loading of the carton. In the constructions which are presently used, the standard practice is to provide a tongue on the longitudinal divider panels which enters an opening in the lateral divider panels and in so doing rides over an edge of the lateral divider panels. The tongue is formed with a notch at its inner end which engages an edge of the lateral divider panel to lock the longitudinal and lateral panels together. This is a conventional tongue and slot type of connection used extensively in carton construction. The problem with this construction is that as the tongue rides over the edge of the lateral divider, it tends to cut a groove in the lateral divider because of the knife edge effect. The groove which is cut in the lateral divider renders the interlocking notch construction ineffective by reason of the fact that the longitudinal divider member can be withdrawn without difficulty because of the groove which it has formed in the lateral divider panel.

A further difficulty which is experienced in the construction of cartons of the type of the present invention is in the provision of a handle reinforcing panel disposed inwardly of one of the end wall panels of the carton. While it has been common practice to form an inwardly overlying reinforcing panel from a portion of the blank, considerable difficulty has been experienced in locating this reinforcing panel in correct register with respect to a hand opening formed in the end wall panel. In addition, difficulty has been experienced in obtaining the material required for the formation of a reinforcing panel without forming a substantial amount of waste in the paperboard stock from which the carton is formed.

The present invention overcomes the difficulties of the prior art described above and provides a simple and effective interlocking structure for locking the bottom wall forming panels and divider panels with respect to one another.

The present invention also provides an improved reinforcing handle construction which permits accurate registration of the reinforcing panel with respect to a hand opening formed in the end wall.

According to an embodiment of the present invention there is provided an improvement in the lay-flat carton of the type described consisting of slot means opening through one of the divider panels at its hinged connection with respect to a side bottom wall panel and lug means projecting outwardly from the other side bottom panel, the lug means mating with the slot means as the carton moves to the erect configuration to provide a bottom wall interlock substantially in the plane of the bottom wall resisting a return to the lay-flat configuration.

According to a further embodiment of the present invention there is provided an improvement in a carton of the type described wherein a side wall handle reinforcing panel is initially formed integrally with an end bottom wall panel. The end bottom wall panel is folded along its hinged connection with an end wall to locate the reinforcing panel in an intimate underlying relationship with respect to the end wall panel. The reinforcing panel is adhesively secured to the end wall panel which it underlies. The reinforcing panel is released from the end bottom wall panel during movement of the carton from the lay-flat configuration to the erect configuration.

The invention will be more clearly understood after reference to the following detailed specification read in conjunction with the drawings wherein FIG. 1 is a plan view of a blank for use in the formation of a carton according to the present invention;

Figure 1:
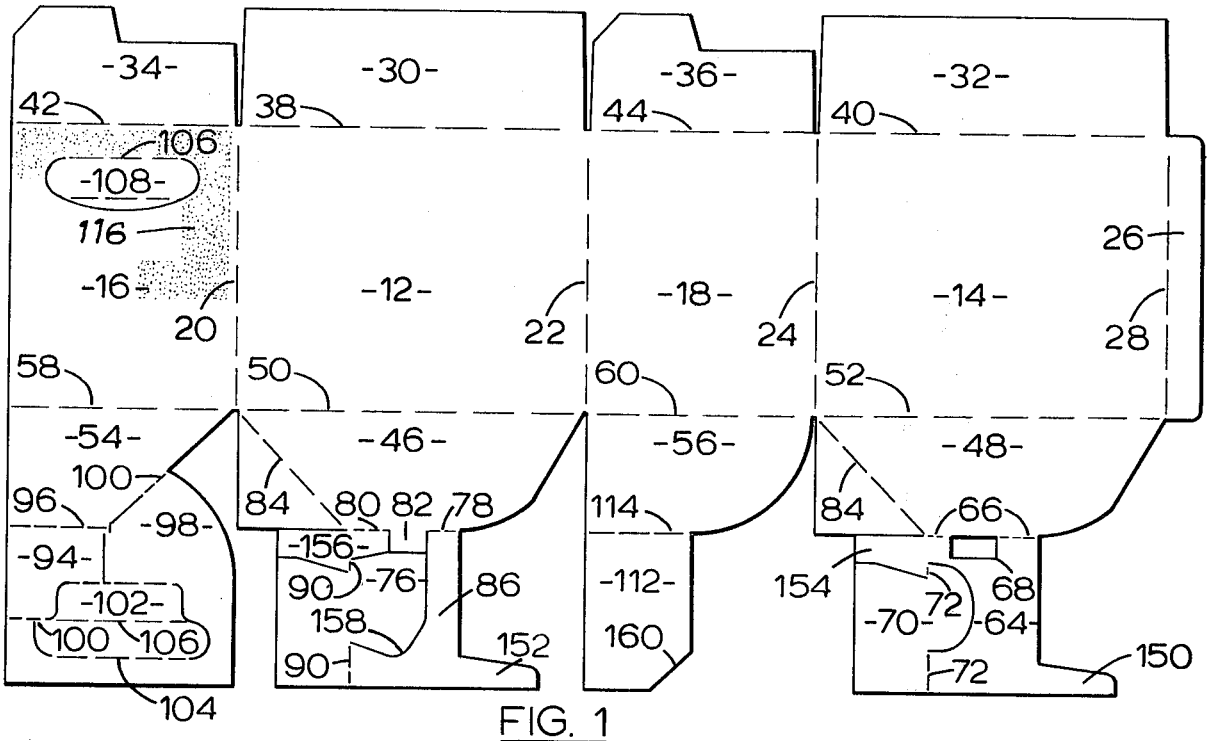

The reference numeral 10 refers generally to a blank suitable for use in the assembly of a carton according to an embodiment of the present invention. The blank consists of side walls 12 and 14 and end walls 16 and 18 hingedly connected along the hinge lines 20, 22 and 24. A glue flap 26 is hingedly connected to one edge of the side wall 14 along hinge line 28. Top closure flaps 30 and 32 are hingedly connected to side wall panels 12 and 14 respectively along hinge lines 38 and 40. The top closure flaps 34 and 36 are hingedly connected to end wall panels 16 and 18 respectively along hinge lines 42 and 44. Composite panels 46 and 48 are hingedly connected along the lower edges of side wall panels 12 and 14 respectively along hinge lines 50 and 52. Composite panels 54, 56 are hingedly connected to the lower edges of end wall panels 16 and 18 respectively along hinge lines 58 and 60 respectively.

The composite panel 48 consists of a side bottom wall portion 62 hingedly connected to a composite divider panel portion 64 along hinge lines 66. An elongated rectangular opening 68 is formed in the divider panel portion 64 and extends to the plane of the hinge line 66. The slot 68 is located substantially centrally of the maximum length of the side bottom wall portion 62. A lateral divider panel 70 is hingedly connected to the longitudinal divider panel 64 along hinge line 72.

The composite panel 46 consists of a side bottom wall forming panel 74 to which a composite divider wall forming panel 76 is hingedly connected along hinge lines 78 and 80. A locking lug 82 is formed integrally with the side bottom wall 74 and is struck from the composite divider panel 76 so that it projects outwardly beyond the fold lines 78 and 80. The panel 46 is also formed with an angularly inclined weakened fold line 84. A similar angularly inclined weakened fold line 84 is formed in the side bottom wall panel 48. The composite divider panel 76 consists of a longitudinal divider portion 86 and a lateral divider portion 88 hingedly connected to the longitudinal divider portion 86 along hinge lines 90.

The composite end bottom panel 54 consists of an end bottom wall portion 92 hingedly connected to a lateral divider portion 94 along hinge line 96, and a detachable handle reinforcing portion 98 which is connected to the end bottom portion 92 and lateral divider portion 94 along weakened tear line 100. The handle reinforcing portion 98 includes a handle flap 102 which is hingedly connected along hinge line 104 and divided into two sections by hinge line 106.

A similar handle flap 108 is hingedly connected to end wall 16 along hinge line 106.

The composite end bottom wall panel 56 consists of an end bottom wall forming portion 110 which is hingedly connected to a lateral divider portion 112 along hinge line 114.

In order to assemble the carton of the present invention, adhesive glue patch 116 is applied to the endwall 16 as shown in FIG. 1 of the drawings. The side bottom wall panels 46 and 48 are folded upon themselves along the weakened fold line 84 so that the triangular lugs 85 which are disposed outwardly of the fold lines 84 are folded in an outwardly overlying relationship with respect to the remainder of their associated side bottom wall panels 46 and 48.

In the next step of forming the assembly, the composite panels 46, 48, 54 and 56 are hinged along fold lines 50, 52, 58 and 60 respectively.

As a result, the handle reinforcing portion of the composite panel 54 is adhesively secured to the inner surface of the end wall 16 in a position in which the handle reinforcing panel 102 is aligned with the handle flap 108. By reason of the fact that the handle reinforcing portion 98 is secured to the bottom wall flap 92 and hinged along the fold line 58, an accurate location of the panel reinforcing panel with respect to the hand opening flap 108 iss ensured. Furthermore, the handle reinforcement is located by the simple act of folding along the line 58.

Figure 2:
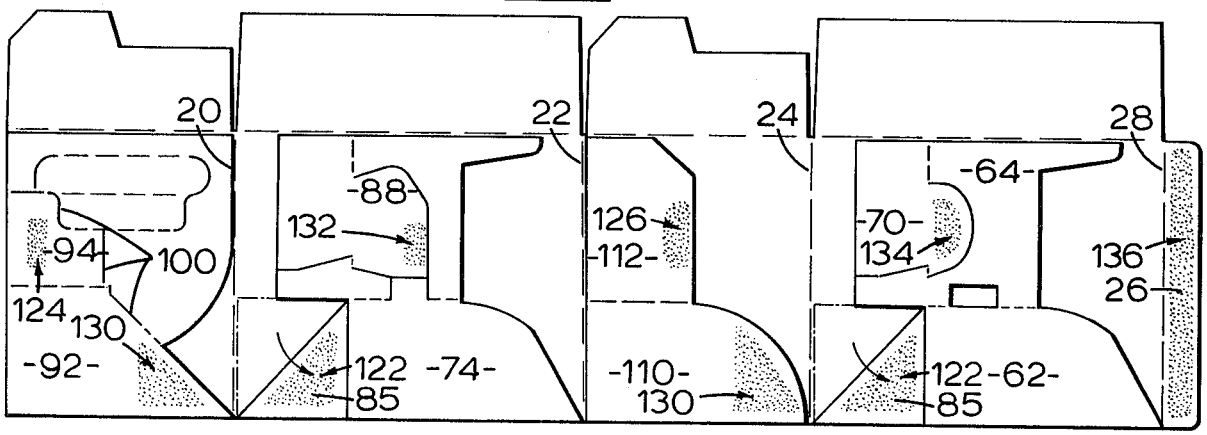
FIG. 2 is a plan view of the blank of FIG. 1 showing the first step in the formation of the carton.
Figure 3:
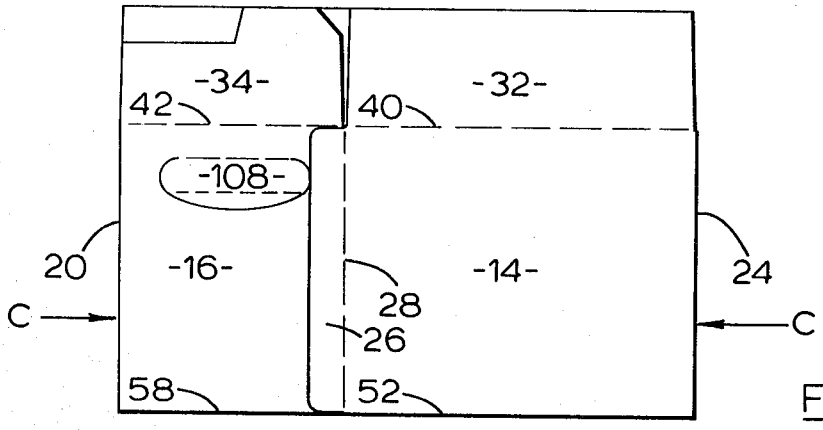
FIG. 3 is a plan view of the blank showing a second folded position in the formation of the carton.

As shown in FIG. 2 of the drawings, the triangular portions 85 are disposed in an outwardly overlying relationship with respect to the remainder of the side bottom wall forming portions 62 and 74. An adhesive glue patch 122 is applied to the exposed surfaces of each of the triangular portions 85.

As shown in FIG. 2 of the drawings, an adhesive glue patch 124 is applied to the lateral divider portion 94 of the composite panel 54. Similarly an adhesive glue patch 126 is applied to the lateral divider portion 112 of the composite panel 56. As will be discribed hereinafter, the glue patches 122 of triangular portions 85 are adhesively secured to the portions of the adjacent end bottom panels 54 and 56 enclosed by the chain line 130. Similarly the glue patch 124 of the lateral divider panel 94 is connected to lateral divider panel portion 88 of the panel 76 in the area bounded by the chain line 132. The glue patch 126 is adhesively secured to the area of the lateral divider portion 70 of the panel 64 in the area bounded by the chain line 134.

An adhesive glue patch 136 is applied to the glue flap 26.

After the glue patches 122, 124, 126 and 136 have been applied when the blank is in the configuration illustrated in FIG. 2 of the drawings, the blank is then folded along hinge line 20 and thereafter along hinge line 24 so that the various glue flaps are applied to their associated glue areas as described above, the glue patch 136 of the glue flap 26 being adhesively secured to the outer face of the end wall 16. The blank has now been assembled to the required lay-flat configuration.

In order to erect the carton, the edges formed at the fold lines 20 and 24 are pushed towards one another in the direction of the arrows C. The effect of this action is to cause the overlying walls to move out away from one another. As a result of this movement, the reinforcing handle portion 98 is severed from the composite bottom wall panel 54 along the weakened tear line 100. In addition, the lateral panel 94 causes a lateral portion 88 of the composite divider panel 76 to hinge along the hinge lines 90 so as to be drawn away from the longitudinal divider portion 86. Similarly, the lateral divider portions 70 of the composite divider panel 64 is caused to hinge about hinge line 72 by reason of its adhesive connection to the lateral divider panel 112. As a result of the adhesive connection between the triangular portions 85 of the side bottom wall panels 62 and 74 with respect to the end bottom wall panels 54 and 56, the bottom wall panels are articulated downwardly as the lay-flat configuration is adjusted to the erect configuration.

Figure 4:
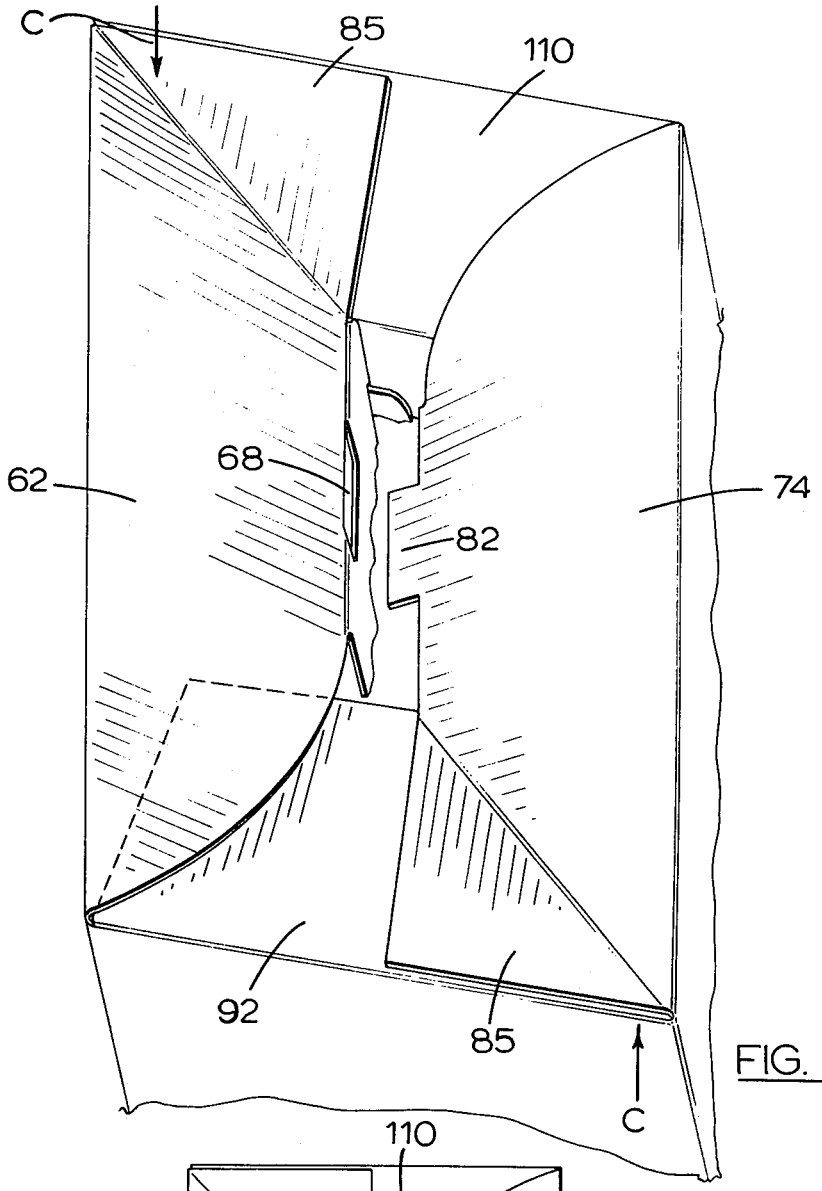
FIG. 4 is a pictorial view of the underside of the carton illustrating the manner in which the bottom wall interlock is formed.
Figure 5:
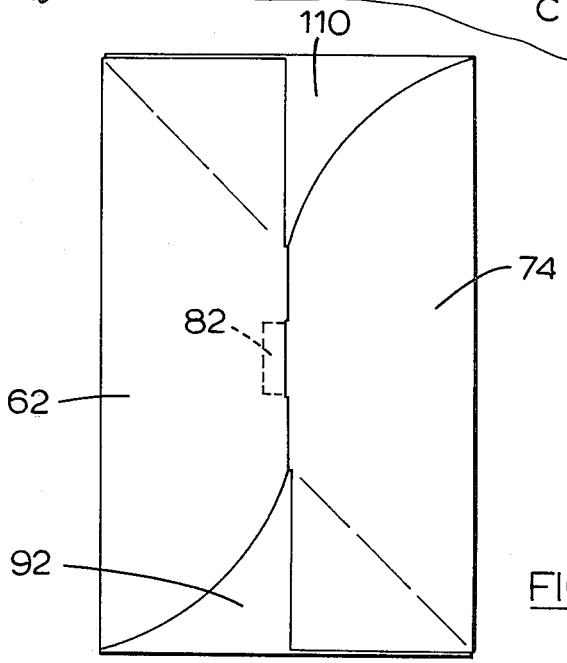
FIG. 5 is a plan view of the underside of a carton in the assembled configuration.

As shown in FIG. 4 of the drawings, as the bottom wall forming panels approach the required closure position the lug 82 approaches the slot 68. Continued movement from the position shown in FIG. 4 to the position shown in FIG. 5 causes the lug 82 to mate with the slot 86 to interlock the bottom wall panels together as shown in FIG. 5 of the drawings. In this condition, the lug 82 extends parallel to the plane of the side bottom panel 62 in an overlying relationship with respect thereto. The lug 82 is preferably positioned and proportioned so as to provide limited interference with the surrounding portions of the longitudinal divider panels 64 as it enters the slot 68 so that a slight deflection of the lug 82 is required during initial entering of the slot 68. The deflection of the lug 82 is permitted by reason of the fact that the height of the slot is substantially greater than the projecting length of lug 82. Once the lug 82 is located in the interlocking position as shown in FIG. 5 of the drawings, there is no interference between the lug 82 and the surrounding portions of the divider panel 64. The projecting length of the lug 82 is such that it extends for a substantial distance in an overlying relationship with respect to the side bottom panel 62 so that interference does occur between the side edge of the lug 82 and the side edge of the slot 68 in circumstances where an attempt is made to move the carton to the lay-flat configuration. Preferably the slot in a carton such as a six-pack beer carton will measure about 1 inch in width and one-half inch in height while the lug 82 measures about seven-eighths of an inch in length and three-eighths of an inch in height.

Figure 6:
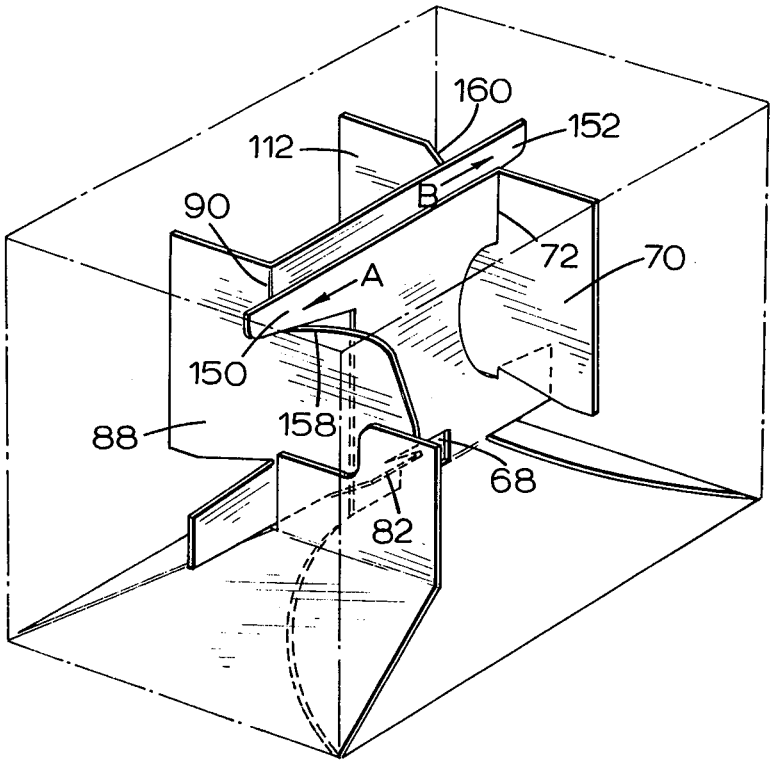
FIG. 6 is a pictorial view illustrating the manner in which the divided panels cooperate to divide the carton container space.

Referring again to FIG. 1 of the drawings, it will be seen that the longitudinal divider panels 64 and 86 have protruding finger portions 150 and 152 respectively extending longitudinally of the upper edge thereof. Similar longitudinally extending protruding portions 154 and 156 are located at the lower edge thereof. In addition, it will be noted that the upper edge 158 of the lateral divider panel 88 is inclined upwardly in a direction away from the upper hinge 90. As shown in FIG. 6 of the drawings, this relationship between the edge 158 and the hinge line 90 is such that a V-shaped recess is formed in the lateral divider panel 88. A similar V-shaped notch is formed between the angularly inclined edge 160 of the lateral divider panel 112 and the hinge line 72 of the lateral divider panel 70. During the erection of the carton, the finger portion 150 moves in the direction of the arrow A and the finger portion 152 moves in the direction of the arrow B. The finger portion 150 is automatically located in the V-shaped recess formed between the edge 158 of the lateral divider panel 88 and its associated hinge line 90 and similarly the finger member 152 is located in the V-shaped notch formed between the angularly inclined edge 160 of the lateral divider panel 112 and the associated hinge line 72 of the lateral divider panel 70. This serves to provide an effective mechanism for aligning the various divider panels in the erect configuration. Because of the fact that the interlocking relationship is achieved by the location of the lug 82 within the slot 68, it is not essential to provide any interlocking notches in the fingers 150 and 152 in order to engage the lateral divider panels. It will be noted, however, that notches may be provided at the inner ends of the underside of the fingers 150 and 152 if required in order to further rigidify the structure.

The longitudinal dividers at one end compartment consist of the finger portion 150 located adjacent the upper end thereof and the finger portion 156 located adjacent the lower edge thereof. At the other end, the longitudinal divider consists of a finger portion 152 at the upper end thereof and the finger portion 154 at the lower end thereof. These finger portions serve to space adjacent bottles at spaced apart points adjacent the upper and lower ends of the bottles and thereby prevent glass to glass contact between the bottles over the full length of the bottles.

From the foregoing it will be apparent that the present invention provides a simple and efficient interlocking structure for automatically securing the divider panels in a direct configuration upon erection of the carton from the lay-flat configuration. In addition, it will be apparent that the reinforcing handle of the present invention is accurately located by reason of the simple act of folding the bottom end panel inwardly upon the end wall. This provides an accurate location of the reinforcement with respect of the handle in the handle panel. In addition, the handle reinforcement is attained from a portion of the blank which falls within the dimensions of the blank required in order to provide the various panels required in the construction of the blank.

These and other advantages of the present invention will be apparent to those skilled in the art.

The embodiments of the invention in which are exclusive property or privilege is claimed are defined as follows:

1. In a lay-flat carton having bottom wall forming side and end panels hingedly connected to side and end panels respectively, the divider panels hingedly connected to each of said bottom wall forming panels and projecting therefrom, the divider panel of each side bottom wall being articulately connected to the divider panel of an adjacent end bottom wall panel whereby upon movement from the lay-flat configuration to the erect configuration, the bottom wall forming panels draw the divider panels into a position dividing the container space into a plurality of compartments, the improvement of slot means opening through one of said divider panels at its hinged connection with respect to a side bottom wall panel, and lug means projecting outwardly from the other of said side bottom wall panels, said lug means mating with said slot means as said container moves to the erect configuration to provide a bottom wall interlock substantially in the plane of the bottom wall resisting a return to the lay-flat configuration.

2. A lay-flat container as claimed in claim 1 wherein the slot and the lug are located centrally of the length of their respective side bottom walls.

3. A carton as claimed in claim 1 wherein said slot means has a height in the direction upwardly from the hinged connection of the longitudinal divider panel with respect to its associated bottom wall which is about equal to the projected length of the lug with which it mates.

4. A carton as claimed in claim 1 wherein said slot has a longitudinal extent in the direction of the hinge line of the other longitudinal divider which is substantially greater than the longitudinal extent of the lug so that the lug enters the slot without difficulty.

5. A carton as claimed in claim 1 wherein said lug means overlies a portion of the opposite side bottom wall panel when located within said slot means.

6. A carton as claimed in claim 1 wherein a portion of each divider panel of each side bottom wall forms a longitudinal divider of said carton, other portions of said divider panels of said side bottom walls at the divider panels of the adjacent end bottom walls to which said other portions are connected forming lateral divider panels, each of the longitudinal divider panel portions being formed to provide finger portions at the upper edge thereof projecting in the direction of the opposed lateral divider panel, said lateral divider panels each having an upwardly directed edge which is shaped to provide a valley centrally of the length thereof, said finger portions of each longitudinal divider extending into the valleys formed in the lateral dividers to be retained therein against lateral deflection.

7. A carton as claimed in claim 1 wherein a side wall handle reinforcing panel is integrally formed with an end bottom wall panel, said end bottom wall panel being folded along its hinged connection with an end wall to locate said panel in an inwardly underlying relationship with respect to said end wall panel.

8. A carton as claimed in claim 7 wherein said end wall has a hand opening forming flap releasably formed therein, said reinforcing panel having a releasable handle panel disposed in register with said handle opening of said end wall when folded along said hinge line to said inwardly underlying relationship.

9. In a carton having a generally rectangular shaped blank configuration providing, side and end wall panels hingedly connected to one another, top closure flaps hingedly connected to said side and end wall panels, one of said end walls having a hand opening formed therein, the improvement of: a side wall handle reinforcement panel formed from blalnk freeboard and integral with the bottom wall panel of the end wall in which the handle opening is formed, said end bottom wall panel being folded along its hinged connection with said end wall to locate said handle reinforcing panel in an underlying relationship with respect to said end panel.

10. A carton as claimed in claim 9 wherein said end wall has a hand opening forming flap releasably formed therein, said reinforcing panel having a releasable handle panel disposed in register with said handle opening of said end wall when folded along said hinge line to said inwardly underlying relationship.

* * * * *